US005123970A

United States Patent [19]

Fang et al.

[11] Patent Number: 5,123,970

[45] Date of Patent: Jun. 23, 1992

[54] METHOD OF PRODUCING AN AIR-HARDENABLE BAINITE-MARTENSITE STEEL

[75] Inventors: Hongsheng Fang; Yankang Zheng; Xiuyun Chen; Donghao Chen; Rufa Zhao, all of Beijing, China

[73] Assignee: Qinghua University, Beijing, China

[21] Appl. No.: 519,048

[22] Filed: May 4, 1990

Related U.S. Application Data

[62] Division of Ser. No. 283,491, Dec. 12, 1988, Pat. No. 4,957,702.

[30] Foreign Application Priority Data

Apr. 30, 1988 [CN] China ..... 88102230.6

[51] Int. Cl.[5] ..... C21D 8/00; C21D 9/00

[52] U.S. Cl. ..... 148/547; 148/653; 164/76.1; 164/476; 164/477

[58] Field of Search ..... 148/2, 3; 164/76.1, 164/476, 477

[56] References Cited

FOREIGN PATENT DOCUMENTS

| | | |
|---|---|---|
| 06103008 | 6/1987 | China . |
| 2302865 | 7/1974 | Fed. Rep. of Germany . |
| 58-034131 | 2/1983 | Japan . |
| 2163454 | 2/1986 | United Kingdom . |

*Primary Examiner*—Deborah Yee
*Attorney, Agent, or Firm*—John R. Pegan

[57] ABSTRACT

Air-hardenable steels of duplex bainite/martensite microstructure consisting essentially of 0.10 to 0.7% C, 0.1 to 2% Si, 2.1 to 3.5% Mn, 0.0005 to 0.005% B, up to 3.5% Cr and preferably containing Cr in amount of at least 0.1%, balance Fe except for incidental impurities. Optional elements are up to 1.5% W, 1.0% Mo, 0.15% V, 0.2% S, 0.1% Ca, 0.1% Pb, 0.1% Ti and 0.2% total rare earths. At least 1.0% Cr is especially preferred and if below such amount, total Mn and Si is at least 3% and in such case, if C is under 0.47%, at least 0.6% Si is present. The steels are hardenable to $R_c$ 2o to $R_c$ 58 and have a hardenable diameter in the range between 35 mm and 80 to 100 mm by air-cooling only, together with good strength, toughness and fatigue- and wear-resistance.

10 Claims, No Drawings

METHOD OF PRODUCING AN AIR-HARDENABLE BAINITE-MARTENSITE STEEL

This is a division of application Ser. No. 07/283,491 filed Dec. 12, 1988, now U.S. Pat. No. 4,957,702.

TECHNICAL FIELD

This invention relates to new steels having a duplex microstructure of bainite and martensite upon air-cooling after hot forming, as by casting or hot forging or rolling and exhibit high hardenability without quenching, together with high strength, toughness and wear resistant properties. Such characteristics suit the steels, for example, to the economical manufacture of structural and equipment parts, fasteners, and dies and other wear-resistant articles.

BACKGROUND OF THE INVENTION

Steels used for structural and wear-resistant applications include, for example, high manganese steels and certain medium carbon steels with or without the hardening and strengthening elements chromium, nickel or molybdenum—such as SAE 4140, SAE 3140 and SAE 1345. High Manganese alloy steels are expensive and require complicated heat treatment to develop required properties. For example, such steels commonly are reheated, for example to around 1100° C., after hot working and then water quenched to form austenite. Heat treatment of SAE 3140, SAE 4140 and SAE 1345 steels also is complicated, requiring oil quenching and high temperature tempering. The strength, toughness and wear-resistance properties of the less expensive steels such as SAE 1345 are quite low.

Such shortcomings of prior art steels were partially overcome by certain medium carbon and medium-high carbon, manganese-boron bainite steels as described in Chinese patent application numbers 86103008 and 87100365. Such steels, having a duplex bainite-martensite structure after air-cooling, are simply processed, have low cost and good strength, toughness and wear resistance. However, such steels have relatively low hardenability after air-cooling. For example, they are hardenable by air-cooling to a hardenable diameter of only about 20 mm. Within such limits, these steels are useful in a forged or rolled condition; they are not useful for application as castings of larger section thicknesses. Attention also is directed to certain low carbon, Mn—Si—B steels, having a principally bainitic structure, as disclosed in U.S. patent application Ser. No. 083,130. Use of such steels provides full section hardenability of bars with a cross-section diameter of at least 30 mm.

The term "hardenable diameter" is commonly used to described the maximum depth dimension throughout which an article is hardenable to a particular hardness level. This term refers to the diameter of a test specimen, normally in the form of a rod or bar having a uniform cross-section normal to the specimen length.

The compositions of such prior art steels, in weight percent, are given in Table 1.

TABLE 1

| | C | Mn | Si | Cr | Ni | Mo | B |
|---|---|---|---|---|---|---|---|
| High Manganese Steel | 1.0 to 1.4% | 11 to 14% | 0.3 to 0.9% | | | | |
| SAE 3140 | 0.37 to 0.44% | 0.5 to 0.8% | 0.2 to 0.4% | 0.45 to 0.75% | 1.0 to 1.4% | | |
| SAE 4140 | 0.38 to 0.45% | 0.5 to 0.8% | 0.2 to 0.4% | 0.9 to 1.2% | | 0.15 to 0.25% | |
| SAE 1345 | 0.42 to 0.49% | 1.4 to 1.8% | 0.2 to 0.4% | | | | |
| Chinese Appln. No. 86103008 | 0.31 to 0.46% | 2.1 to 3.4% | 0.1 to 1.5% | | | | 0.0005 to 0.005% |
| Chinese Appln. No. 87100365 | 0.47 to 0.60% | 2.1 to 3.5% | 0.1 to 1.5% | | | | 0.0005 to 0.005% |
| U.S. Appln. No. 083,130 | 0.10 to 0.25% | 2.0 to 3.2% | 0.3 to 1.5% | | | | |

The last three Table 1 steels optionally may contain up to 1.5% of tungsten or chromium, up to 1% molybdenum and up to 0.15% vanadium.

DISCLOSURE OF INVENTION

An outstanding contribution of the duplex bainite-martensite steels of this invention is that high hardness levels can be obtained throughout a hardenable diameter substantially greater than is obtainable with previously known steels. These new steels contain, as essential elements, carbon, silicon, manganese and boron. The steels also contain chromium, although in one embodiment of the invention chromium may be omitted if the manganese, carbon and silicon contents are present in sufficiently large amounts to provide the desired structure and properties, as hereinafter described. The steels are useful either in the forged or rolled or in the cast condition, followed by air-cooling from above the austenitizing temperature, e.g. about 820–950 deg. C., without quenching or temperature or, for some applications, with tempering only. The hardenability characteristics of these steels, together with their high strength, toughness and wear resistance, and the long-term property stability of the steels, admirably suit them to a wide variety of applications such as the manufacture of various forged structural articles; cast articles of high wear-resistance such as grinding and crusher liner plates, balls and rods, as well as wear-resistant articles such as dies which must accept and retain a high surface finish free of cracks and dimensional changes caused by the thermal shock of quenching.

The steels of this invention utilize only relatively small amounts of low-cost elements such as manganese, silicon and boron, and the element chromium which is relatively less scarce and expensive as compared to molybdenum and tungsten which are used in many prior art steels for such applications. A broad composition range of the new steels, in weight percent, is given in Table 2.

TABLE 2

| element | composition range, wt % |
|---|---|
| C | 0.10 to 0.7 |
| Mn | 2.1 to 3.5 |
| Cr | up to 3.5 |
| Si | up to 2.0 |
| B | 0.0005 to 0.005 |
| Fe | balance |

A more limited range of the Table 2 steels includes at least 0.15% carbon, at least 0.10% silicon and at least 0.10% chromium. In each case, one or more other alloying elements optionally may be added as follows:

| element | composition range, wt % |
|---|---|
| W | up to 1.5 |
| Mo | up to 1.0 |
| V | up to 0.15 |
| S | up to 0.2 |
| Ca | up to 0.1 |
| Pb | up to 0.1 |
| Ti | up to 0.1 |
| rare earth elements | up to 0.2 |

Chromium preferably is provided in an amount of at least 0.6% and preferably over 1% and up to 2%, especially in steels containing under about 0.5% carbon. If chromium is omitted, or when it is present in an amount under 1%, a combined manganese and silicon content of at least about 3% is used; and the silicon content of such steels should be at least 0.6% where carbon is under about 0.5%, and at least about 0.8% where the carbon content of such low chromium or chromium-free steels is under 0.2%. Such proportioning of the elements, manganese, silicon and chromium, together with carbon and boron, provides enhanced hardenability in the present steels by air-cooling only. In particular, we have found that the addition of chromium and/or the use of the elements manganese, silicon and carbon in the described range and compositional balance is necessary for obtaining such hardenability and therefore for practical casting applications and for more rigorous forged product applications requiring a combination of high hardenability, strength and toughness. Where chromium is 1% or more and the steel composition is balanced as above-described, the hardenable diameter is at least 35 mm. Hardenable diameter up to about 80 to 100 mm. is achievable. If Cr is over 1.0% and Si is over 0.8%, in the lower or medium carbon ranges from 0.10 to about 0.46%, Rockwell hardnesses upwardly of about $R_c$ 20 to $R_c$ 40 or 50 are obtainable. As carbon content of the new steels is increased to the medium high range of 0.47 to 0.7%, attainable hardness of the steels exceeds $R_c$ 50 to $R_c$ 58.

For specific applications, the steel composition can be varied within the above-described element ranges. Proper balance of carbon with other alloying elements provides a good combination of strength and toughness. If carbon is less than 1.10%, steel strength is to low; if higher than about 0.70%, toughness of the steel is too low. If carbon and chromium are too low, for example, below about 0.47% and 1% respectively, hardenability is adversely affected unless manganese and silicon are used in the minimum amounts above-described.

Formation of bainite after air-cooling depends upon addition of the proper amounts of manganese and boron which influence the position of the time-temperature-transformation (the "T-T-T") and the continuous-cooling-transformation (the "C-C-T") curves of the steel.

Hardenability of the steel also can be further enhanced by use of the optional element molybdenum which also aids in avoiding temper brittleness.

The carbide-forming elements vanadium and titanium can be added for grain refinement.

The new steels are easily machined. Machinability can be further enhanced by additions of sulfur, calcium or lead. Rare earths may be added for spheroidizing sulfide inclusions.

BEST MODE OF PRACTICING THE INVENTION

Exemplary, more specific, compositional ranges are given in Tables 3 to 22, wherein the aforesaid principles are to be taken into account, including the described balancing of the required elements C, Cr, Si and Mn.

TABLE 3

| A composition as in Table 2 wherein the steels contain: | |
|---|---|
| element | composition range, wt % |
| C | 0.10 to 0.25 |
| Mn | 2.1 to 2.7 |

TABLE 4

| A composition as in Table 2 wherein the steels contain: | |
|---|---|
| element | composition range, wt % |
| C | 0.10 to 0.25 |
| Mn | 2.4 to 3.5 |

TABLE 5

| A composition as in Table 2 wherein the steels contain: | |
|---|---|
| element | composition range, wt % |
| C | 0.10 to 0.25 |
| Mn | 2.1 to 2.7 |
| Cr | 0.1 to 1.5 |

TABLE 6

| A composition as in Table 2 wherein the steels contain: | |
|---|---|
| element | composition range, wt % |
| C | 0.10 to 0.25 |
| Mn | 2.1 to 2.7 |
| Cr | 1.6 to 3.5 |

TABLE 7

| A composition as in Table 2 wherein the steels contain: | |
|---|---|
| element | composition range, wt % |
| C | 0.10 to 0.25 |
| Mn | 2.4 to 3.5 |
| Cr | 0.1 to 1.5 |

TABLE 8

| A composition as in Table 2 wherein the steels contain: | |
|---|---|
| element | composition range, wt % |
| C | 0.10 to 0.25 |
| Mn | 2.4 to 3.5 |
| Cr | 1.6 to 3.5 |

TABLE 9

| A composition as in Table 2 wherein the steels contain | |
|---|---|
| element | composition range, wt % |
| C | 0.26 to 0.34 |
| Mn | 2.1 to 2.7 |

TABLE 10

| A composition as in Table 2 wherein the steels contain: | |
|---|---|
| element | composition range, wt % |
| C | 0.26 to 0.34 |
| Mn | 2.4 to 3.5 |

TABLE 11

| A composition as in Table 2 wherein the steels contain | |
|---|---|
| element | composition range, wt % |
| C | 0.26 to 0.34 |
| Mn | 2.1 to 2.7 |
| Cr | 0.1 to 1.5 |

TABLE 12

| A composition as in Table 2 wherein the steels contain | |
|---|---|
| element | composition range, wt % |
| C | 0.26 to 0.34 |
| Mn | 2.1 to 2.7 |
| Cr | 1.6 to 3.5 |

TABLE 13

| A composition as in Table 2 wherein the steels contain | |
|---|---|
| element | composition range, wt % |
| C | 0.26 to 0.34 |
| Mn | 2.4 to 3.5 |
| Cr | 0.1 to 1.5 |

TABLE 14

| A composition as in Table 2 wherein the steels contain | |
|---|---|
| element | composition range, wt % |
| C | 0.26 to 0.34 |
| Mn | 2.4 to 3.5 |
| Cr | 1.6 to 3.5 |

TABLE 15

| A composition as in Table 2 wherein the steels contain: | |
|---|---|
| element | composition range, wt % |
| C | 0.35 to 0.46 |
| Mn | 2.1 to 2.7 |

TABLE 16

| A composition as in Table 2 wherein the steels contain: | |
|---|---|
| element | composition range, wt % |
| C | 0.35 to 0.46 |
| Mn | 2.4 to 3.5 |

TABLE 17

| A composition as in Table 2 wherein the steels contain: | |
|---|---|
| element | composition range, wt % |
| C | 0.35 to 0.46 |
| Mn | 2.1 to 2.7 |
| Cr | 0.1 to 1.5 |

TABLE 18

| A composition as in Table 2 wherein the steels contain | |
|---|---|
| element | composition range, wt % |
| C | 0.35 to 0.46 |
| Mn | 2.1 to 2.7 |
| Cr | 1.6 to 3.5 |

TABLE 19

| A composition as in Table 2 wherein the steels contain: | |
|---|---|
| element | composition range, wt % |
| C | 0.35 to 0.46 |
| Mn | 2.4 to 3.5 |
| Cr | 0.1 to 1.5 |

TABLE 20

| A composition as in Table 2 wherein the steels contain: | |
|---|---|
| element | composition range, wt % |
| C | 0.35 to 0.46 |
| Mn | 2.4 to 3.5 |
| Cr | 1.6 to 3.5 |

TABLE 21

| A composition as in Table 2 wherein the steels contain: | |
|---|---|
| element | composition range, wt % |
| C | 0.47 to 0.70 |
| Mn | 2.1 to 2.7 |

TABLE 22

| A composition as in Table 2 wherein the steels contain: | |
|---|---|
| element | composition range, wt % |
| C | 0.47 to 0.70 |
| Mn | 2.4 to 3.5 |

TABLE 23

| A composition as in Table 2 wherein the steels contain: | |
|---|---|
| element | composition range, wt % |
| C | 0.47 to 0.70 |
| Mn | 2.1 to 2.7 |
| Cr | 0.1 to 1.5 |

TABLE 24

| A composition as in Table 2 wherein the steels contain: | |
|---|---|
| element | composition range, wt % |
| C | 0.47 to 0.70 |
| Mn | 2.4 to 3.5 |
| Cr | 1.6 to 3.5 |

TABLE 25

| A composition as in Table 2 wherein the steels contain: | |
|---|---|
| element | composition range, wt % |
| C | 0.47 to 0.70 |
| Mn | 2.4 to 3.5 |
| Cr | 0.1 to 1.5 |

TABLE 26

| A composition as in Table 2 wherein the steels contain: | |
|---|---|
| element | composition range, wt % |
| C | 0.47 to 0.70 |
| Mn | 2.1 to 2.7 |

TABLE 26-continued

| A composition as in Table 2 wherein the steels contain | |
|---|---|
| element | composition range, wt % |
| Cr | 1.6 to 3.5 |

for example, to dies for plastics, rubber and metals, for grinding balls and rods, other wear-resistant pieces, and for hard-facing welding rods.

Exemplary properties of these new steels are illustrated by the following:

| Steel Type | Tensile Strength kg/mm² | 0.2% Off-Set Yield Strength, kg/mm² | Impact Strength AK, KJ/M² (U-notch) | Hardness Rc |
|---|---|---|---|---|
| Low Carbon | | | | |
| 1 | ≧70 | ≧50 | ≧700 | ≧21 |
| 2 | ≧82 | ≧63 | ≧580 | ≧24 |
| 3 | ≧110 | ≧85 | ≧450 | ≧33 |
| 4 (free machining) | ≧70-110 | ≧50-83 | ≧700-450 | ≧21-40 |
| Medium Carbon | | | | |
| 1 | ≧130 | ≧120 | ≧300 | ≧40-50 |
| 2 | ≧90-130 | ≧70-120 | ≧300 | ≧30-50 |
| Medium-High Carbon | — | — | ≧100 | ≧52 |
| Casting Steel | | | | |
| 1 | ≧120 | — | ≧400 | ≧40 |
| 2 | — | — | ≧130 | ≧50 |
| 3 | — | — | ≧70 | ≧54 |
| Welding Rod Steel | — | — | — | ≧52 |

The low to medium carbon steels of Tables 3 to 14 are particularly useful for the manufacture of cast articles such as liner plates and shock plates of crushers and grinders, as well as rolled or forged structural and machine parts such as oil pump sucker rods, reinforcing rods; bolts, nuts and other fasteners, and automotive axles and connecting rods.

The medium carbon steels of Tables 15-20 are useful, for example, in the production of gear racks, various springs, cutting and other elements forming machines, dies, and wear-resistant pieces.

The higher carbon steels of Tables 21-26, capable of hardening to over $R_c$ 50, are especially useful as applied, The present steels can be smelted in oxygen-blown converters and in electric furnaces.

For casting applications, casting temperature is in the range of about 1500° to 1650° C. After casting, the cast article is reheated and air-cooled and the casting used either directly or after tempering.

Forging, rolling and other hot-forming of the new steels is carried out by heating the steel to or above the austenitizing temperature, for example, to about 1050° C. to about 1250° C., finishing at a temperature over about 800° C., and air-cooling.

Specific examples of the steels of this invention are given in Tables 27 and 28.

TABLE 27

| No. | C | Cr | Si | Mn | B | Mo | V | W | S | Ca | Pb | Ti |
|---|---|---|---|---|---|---|---|---|---|---|---|---|
| 1. | 0.10 | 0.8 | 0.7 | 2.8 | 0.002 | | | | | | | |
| 2. | 0.18 | 1.5 | 0.8 | 2.3 | 0.003 | | | | | | | |
| 3. | 0.20 | 2.0 | 1.5 | 2.5 | 0.002 | | | | 0.08 | 0.09 | | |
| 4. | 0.22 | 1.5 | 0.8 | 2.2 | 0.003 | | | | | | | |
| 5. | 0.25 | 1.6 | 0.8 | 2.9 | 0.001 | | | | 0.07 | 0.09 | | |
| 6. | 0.28 | 1.8 | 1.5 | 2.6 | 0.002 | | | 0.20 | | | | |
| 7. | 0.29 | 1.6 | 0.7 | 2.4 | 0.002 | | | | | | | |
| 8. | 0.30 | 3.0 | 0.8 | 2.2 | 0.003 | | | | | | | |
| 9. | 0.30 | 1.8 | 1.0 | 2.3 | 0.002 | 0.3 | | | | | | |
| 10. | 0.32 | 2.0 | 0.8 | 2.7 | 0.003 | | 0.08 | | | | | |
| 11. | 0.34 | 2.5 | 0.6 | 2.9 | 0.001 | | | | 0.07 | 0.09 | | |
| 12. | 0.35 | 0.8 | 0.8 | 2.3 | 0.003 | | | | | | 0.10 | |
| 13. | 0.36 | 3.0 | 0.6 | 2.4 | 0.002 | | | | | | | |
| 14. | 0.38 | 1.2 | 1.0 | 2.5 | 0.002 | | | | | | | 0.06 |
| 15. | 0.40 | 0.8 | 1.5 | 2.7 | 0.003 | 0.2 | | | | | | |
| 16. | 0.40 | 1.6 | 0.7 | 2.8 | 0.001 | | | | | | | |
| 17. | 0.42 | 1.8 | 1.0 | 2.3 | 0.002 | | | | | | | |
| 18. | 0.42 | 2.0 | 0.8 | 2.7 | 0.002 | | | | | | | |
| 19. | 0.43 | 2.1 | 0.6 | 2.4 | 0.003 | | | | | | | |
| 20. | 0.43 | 2.2 | 0.7 | 2.6 | 0.002 | | | | | | | |
| 21. | 0.45 | 2.0 | 1.0 | 2.7 | 0.003 | | | | | | | |
| 22. | 0.45 | 2.2 | 0.8 | 2.6 | 0.002 | | | | | | | |
| 23. | 0.46 | 2.5 | 0.7 | 2.5 | 0.003 | 0.3 | | | | | | |
| 24. | 0.46 | 2.5 | 0.6 | 2.4 | 0.003 | | | | | | | |

TABLE 28

| No. | C | Cr | Si | Mn | B | Mo | V | W | S | Ca | Pb | Ti |
|---|---|---|---|---|---|---|---|---|---|---|---|---|
| 25. | 0.49 | 0.6 | 1.5 | 2.6 | 0.003 | | | | | | | |
| 26. | 0.50 | 1.3 | 0.9 | 2.2 | 0.001 | | | | | | | |
| 27. | 0.54 | 0.8 | 0.5 | 2.7 | 0.003 | 0.3 | | | | | | |
| 28. | 0.55 | 2.4 | 0.7 | 2.8 | 0.002 | | 0.15 | | | | | |
| 29. | 0.48 | 1.6 | 0.5 | 2.4 | 0.002 | | | 0.7 | | | | |
| 30. | 0.47 | 1.8 | 0.5 | 2.6 | 0.002 | | | | | | | |

TABLE 28-continued

| No. | C | Cr | Si | Mn | B | Mo | V | W | S | Ca | Pb | Ti |
|---|---|---|---|---|---|---|---|---|---|---|---|---|
| 31. | 0.49 | 2.5 | 0.8 | 2.3 | 0.002 | | | | 0.07 | 0.08 | | |
| 32. | 0.50 | 1.2 | 0.9 | 2.5 | 0.002 | | | | 0.10 | | | |
| 33. | 0.52 | 0.6 | 1.5 | 2.3 | 0.002 | | | | | | 0.1 | |
| 34. | 0.57 | 1.3 | 0.7 | 2.2 | 0.003 | | | | | | | 0.06 |
| 35. | 0.48 | 3.0 | 0.6 | 2.3 | 0.002 | | | | | | | |
| 36. | 0.49 | 1.5 | 1.0 | 2.4 | 0.003 | | | | | | | |
| 37. | 0.47 | 1.8 | 0.8 | 2.8 | 0.001 | | | | | | | |
| 38. | 0.52 | 2.0 | 0.9 | 2.6 | 0.002 | | | | | | | |
| 39. | 0.49 | 2.5 | 1.0 | 2.9 | 0.002 | | | | | | | |
| 40. | 0.48 | 2.5 | 0.8 | 2.3 | 0.003 | | | | | | | |

Steels having composition as in Examples 2 to 11 of Table 27 were used to produce cast liner plates of crushers. Casting temperatures were in the range of 1500°-1650° C. The plates were air-cooled after casting or reheated, and subsequently tempered at 150°-350° C. The resulting hardness of the plates was greater than $R_c$ 40.

Automobile springs and railway springs were made of steels with compositions as in Examples 14 to 24 of Table 27. Rods for fabrication of the springs were rolled or forged at 1200°-850° C., subsequently cooled either in still air or by use of simple fan cooling, and then tempered in the range of 150° to 500° C. Thereafter, the rods were reheated to forging temperature, hot worked to final form, air-cooled and then tempered at 150° to 500° C. After such processing, the steels had a duplex bainite-martensite structure and exhibited yield strengths of at least 120 Kg/mm$^2$ and tensile strengths of at least 130 Kg/mm$^2$. The toughness and fatigue properties of these steels are exemplified in Tables 29 and 30.

TABLE 29

| | Fracture Toughness | |
|---|---|---|
| property | this invention[1] | comparison steel[2] |
| KIC[3] | at least 280 Kg.mm$^{-3/2}$ | 200 to 260 Kg.mm$^{-3/2}$ |
| KISCC[4] | at least 110 Kg.mm$^{-3/2}$ | at least 98 Kg.mm$^{-3/2}$ |

[1]Example No. 14 of Table 27
[2]60Si2Mn (0.56-0.64% C, 1.5-2.0% Si, 0.6-0.9% Mn), quenched from 870° C. in oil and tempered at 480-500° C.
[3]KIC is fracture toughness
[4]KISCC is fracture toughness per stress corrosion cracking test (in 3% NaCl solution)

TABLE 30

| | Fatigue Properties | | |
|---|---|---|---|
| | Test load, Kg/mm$^2$ | | Fatigue Life, |
| | maximum | minimum | No. of cycles, N |
| this invention[1] | 100 | 10 | 9-12 × 10$^4$ |
| comparison steel[2] | 100 | 10 | 5-7 × 10$^4$ |

[1]Example No. 14 of Table 27
[2]60Si2Mn, quenched from 870° C. in oil and tempered at 480-500° C.

These new steels, developing a duplex bainite/martensite structure hardenable upon air cooling as described, are admirably suitable for the manufacture of precision dies requiring high surface hardness and finish with little shape change during drastic temperature cycling operation, for example, in the manufacture of plastics, rubber, formaldehyde condensation resin products and non-ferrous metal products. For example, dies made from steels having compositions as in Examples 31 to 40 of Table 28 were uniform in microstructure and, because no further heat treatment is needed, they hold their original shape and surface finish. Such dies thus can be made and used with little rejection rate of either the dies themselves of the products made with their use. Similarly, dies were made of steels having composition is as in Examples Nos. 2 to 9 of Table 27. After forging or rolling, Rockwell hardnesses of $R_c$ 35 to $R_c$ 40 were obtained. The steels then were machined into final die shape and directly used without quenching and tempering. These steels having an $R_c$ hardness of 35 to 40 are easily machined.

In further illustration of the invention, ingots of the Table 28 compositions were forged or rolled at 850° c. to 1250° C. into the form of die blanks. After cold working, the dies were heated to austenitizing temperature, 800°-950° C., and air-cooled and tempered. Bending strengths, $\sigma_{bb}$ of at least 260 Kg.mm$^2$ were obtained. Alternatively, the die blanks may be tempered to obtain a hardness of $R_c$ 35 to $R_c$ 40, and then machined to final shape in which form they can be directly used, without quenching or further tempering.

Steels having compositions as in Examples 28 to 36 of Table 28 are useful in the manufacture of ball mill grinding balls and other articles of high hardness and superior wear resistance and small crumbling rate. Other applications include large gear racks of mining machines and other parts requiring high hardness, wear-resistance and strength, and particularly where quenching after hot working is not practical or economically feasibly. Wear resistance of such steels is illustrated in Table 31.

TABLE 31

| | Abrasive rate (w) | | | |
|---|---|---|---|---|
| | w (grams/meter) × 10$^{-3}$ of indicated load | | | |
| Steel | 1.5 Kg | 2.5 Kg | 3.5 Kg | 5.5 Kg |
| SAE 1345[1] | 2.27 | 3.29 | 4.22 | 6.43 |
| present invention[2] | 2.06 | 3.10 | 3.92 | 5.80 |

[1]Composition is shown in Table 1. Quenched and tempered
[2]Example No. 28 of Table 28.

From the foregoing description and examples, it can be seen that the invention provides new steels having an excellent combination of hardenability, strength, toughness and fatigue- and wear-resistance. Due to their superior hardenability, the steels can be used for making various types of heavy machinery parts and other large size articles in either forged or cast condition. The steels are air-hardenable after hot working or casting. Hence, conventional quenching or quenching-tempering treatments are not needed. Amenability of the steels to various forming procedures during air-cooling after the previous hot working (for example, in the production of large springs) combines the formation of bainite/martensite microstructure and other benefits of hot working. The occurrence of various defects due to repeated heating and quenching such as distortions, cracking, oxidation and decarbonization are largely avoided because the fabrication procedures are simplified, and the number and types of necessary heat treatments are reduced. Consequently, the use of the new steels results in savings in energy and other manufacturing costs, and product application coats, and hence in an increase in overall economic benefits. In addition, the use of the new steels improves working conditions and reduces environmental pollution.

The new steels are useful in production of articles in which final forming is done by working the steel at a temperature below that previously used for hot-working the steel prior to air-cooling (cold working or semi-hot working). Steels wherein the carbon content is up to about 0.46% are particularly useful in this respect, especially in case of articles having relatively large thicknesses. Smaller section articles such as wire, for example, for reinforcing mesh or springs, may be made by cold-working, following hot-working and air-cooling, the steels of higher carbon contents within the above-described broad range.

Relatedly, in another aspect of this invention, the inventive steels, especially those having higher carbon contents within the described broad range, may be produced with lower hardness and strength than exhibited by the bainite-containing microstructure by cooling the hot worked steel more slowly than the cooling rate in still air, for example less than about 300° C. per hour. The resulting, softer pearlite or pearlite plus ferrite structure is more easily cold worked than the harder, stronger bainite or bainite/martensite structure. Illustratively, these new steels are useful in the manufacture of cold heading wire and rod. The hot worked steel may be slowly cooled by known means in an environment reducing rate of heat loss from the cooling steel. For example, in the case of cold heading steel, the hot rolled rod may be laid in loop form on a conveyor which is insulated or to which heat may be added to suitably slow the cooling rate to an extent to provide the softer pearlite or pearlite/ferrite structure. Similarly, products such as rolled or forged die blocks or flats, or fastener stock, can be slow cooled to avoid bainite formation. After cold working such articles, they may be heated above the austenitizing temperature and then air-cooled to form the hard, strong bainite or bainite/martensite structure.

Still further, the surface of an article of the new steels having a pearlite or pearlite/ferrite structure can be heated and air-cooled to form a hard, strong bainite-containing surface.

We claim:

1. A method of producing an air-hardenable bainite-martensite steel having a hardenable diameter of at least about 35 mm and a hardness of at least about $R_C$ 20 and suitable either for casting directly into a useful articles form or, after casting, for hot working in a temperature range from about 800° C. to about 1250° C., said method comprising casting, at a temperature from about 1500° C. to about 1650° C., a molten steel containing, by weight percent:

| | |
|---|---|
| carbon | 0.1 to 0.7% |
| manganese | 2.1 to 3.5% |
| silicon | 0.1 to 2% |
| chromium | 0.1 to 3.5% |
| boron | 0.0005 to 0.005%, |

and air-cooling the cast and solidified steel from above the austenitizing temperature, without quenching.

2. A method according to claim 1, wherein the steel contains from 0.1 to 0.46% carbon, and wherein the method further comprises the step of tempering the cast and air-cooled steel at a temperature in the range of about 150° C. to about 650° C.

3. A method of forming a useful steel article comprising hot forming a precursor steel article of an air-hardenable steel containing, by weight percent:

| | |
|---|---|
| carbon | 0.1 to 0.7% |
| manganese | 2.1 to 3.5% |
| silicon | 0.1 to 2% |
| chromium | 0.1 to 3.5% |
| boron | 0.0005 to 0.005%, |

heating the precursor article to a temperature at least equal to the austenitizing temperature of the steel, and working the precursor article to a useful article form within a temperature range from the austenitizing temperature to ambient temperature while air-cooling the steel article.

4. A method according to claim 3, wherein the carbon content of the steel is from 0.10 to 0.46% by weight.

5. A method of producing an air-hardenable bainite-martensite steel having a hardenable diameter of at least about 35 mm and a hardness of at least about $R_C$ 20 and suitable either for casting directly into a useful article form or, after casting, for hot working in a temperature range from about 800° C. to about 1250° C., said method comprising casting, at a temperature from about 1500° C. to about 1650° C., a molten steel containing, by weight percent:

| | |
|---|---|
| carbon | 0.1 to 0.7% |
| manganese | 2.1 to 3.5% |
| silicon | 0.1 to 2% |
| chromium | 0.1 to 3.5% |
| boron | 0.0005 to 0.005%, |

solidifying the cast steel, hot working the cast steel at a temperature from about 850° C. to about 1250° C., finishing the hot working at a temperature over 800° C., air cooling the steel and tempering the steel at a temperature within the range from about 150° C. to about 150° C.

6. A method of producing an air-hardenable bainite-martensite steel having a hardenable diameter of at least about 35 mm and a hardness of at least about Rc 20 and suitable either for casting directly into a useful article form or, after casting, for hot working in a temperature range from about800° C. to about 1250° C., said method comprising casting, at a temperature from about 1500° C. to about 1650° C., a molten steel containing, by weight percent:

| | |
|---|---|
| carbon | 0.1 to 0.46% |
| manganese | 2.1 to 3.5% |
| silicon | 0.1 to 2% |
| chromium | 0.1 to 3.5% |
| boron | 0.0005 to 0.005%, |

solidifying the cast steel, hot working the cast steel at a temperature from about 850° C. to about 1250° C., finishing the hot working at a temperature over 800° C., and then further warm working the steel at a temperature below the hot working and finishing range.

7. A process of working and heat treating a steel article having a composition consisting essentially, by weight percent, of:

| | |
|---|---|
| carbon | 0.26 to 0.70% |
| manganese | 2.1 to 3.5% |
| silicon | 0.1 to 2% |
| boron | 0.0005 to 0.005% |
| chromium | up to 3.5% |
| tungsten | up to 1.5% |
| molybdenum | up to 1.5% |
| vanadium | up to 0.15% |
| sulfur | up to 0.2% |
| calcium | up to 0.1% |
| titanium | up to 0.1% |
| rare earth elements | up to 0.2% total |
| iron | balance, except for incidental steelmaking impurities |

wherein if the amount of chromium is less than 1%, the steel contains manganese and silicon in combined amount of at least 3%, which process comprises hot working the steel at a temperature above the austenitizing temperature, cooling the steel under retarded cooling conditions to form a microstructure selected from the group consisting of pearlite and pearlite plus ferrite, cold working the steel to a useful articles form, reheating the cold worked article to a temperature above the austenitizing temperature, and then air-cooling the articles to form a hardenable bainite/martensite microstructure.

8. A method of producing an air-hardenable bainite-martensite steel having a hardenable diameter of at least about 35 mm and a hardness of at least about $R_c$ 20 and suitable either for casting directly onto a useful article form or, after casting, for hot working in a temperature range from about 800° C. to about 1250° C., said method comprising casting, at a temperature from about 1500° C. to about 1650° C., a molten steel containing, by weight percent:

| | |
|---|---|
| carbon | 0.1 to 0.34% |
| manganese | 2.1 to 3.5% |

-continued

| | |
|---|---|
| silicon | 0.1 to 2% |
| chromium | 0.1 to 3.5% |
| boron | 0.0005 to 0.005%. |

into the form of a final useful casting, reheating the unworked casting to a temperature above the steel austenitizing temperature, and air-cooling the casting.

9. A method according to claim 6, comprising air-cooling the hot worked steel to a temperature within the range from below the hot working temperature to room temperature, reheating the steel to a temperature below the hot working temperature and warm working the steel.

10. A method of producing an air-hardenable bainite-martensite steel having a hardenable diameter of at least about 35 mm and a hardness of at least about $R_c$ 20 and suitable either for casting directly into a useful article form or, after casting, for hot working, said method comprising casting a molten steel consisting essentially, by weight percent:

| | |
|---|---|
| carbon | 0.1 to 0.7% |
| manganese | 2.1 to 3.5% |
| silicon | 0.1 to 2% |
| boron | 0.0005 to 0.005% |
| chromium | up to 3.5% |
| tungsten | up to 1.5% |
| molybdenum | up to 1.5% |
| vanadium | up to 0.15% |
| sulfur | up to 0.2% |
| calcium | up to 0.1% |
| titanium | up to 0.1% |
| rare earth metals | up to 0.2% total |
| iron | balance, except for incidental steelmaking impurities. |

which process comprises solidifying the steel, hot working the cast and solidified steel at a temperature from about 850° C. to about 1250° C., finishing the hot working at a temperature over 800° C., and then air-cooling the steel.

* * * * *